US010665961B1

(12) United States Patent
McMahon et al.

(10) Patent No.: US 10,665,961 B1
(45) Date of Patent: May 26, 2020

(54) DUAL MODE ARRAY ANTENNA

(71) Applicant: BAE SYSTEMS INFORMATION AND ELECTRONIC SYSTEMS INTEGRATION INC., Nashua, NH (US)

(72) Inventors: Benjamin G. McMahon, Nottingham, NH (US); Christopher K. Cheung, Newton, MA (US); Robert W. Rogers, Rochester, NH (US); Court E. Rossman, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 83 days.

(21) Appl. No.: 16/197,703

(22) Filed: Nov. 21, 2018

(51) Int. Cl.

| | |
|---|---|
| ***H01Q 21/22*** | (2006.01) |
| ***H01Q 1/36*** | (2006.01) |
| ***H01Q 3/38*** | (2006.01) |
| ***H01Q 1/52*** | (2006.01) |
| ***H01Q 1/24*** | (2006.01) |

(52) U.S. Cl.
CPC ..... *H01Q 21/22* (2013.01); *H01Q 1/247* (2013.01); *H01Q 1/36* (2013.01); *H01Q 1/523* (2013.01); *H01Q 3/38* (2013.01)

(58) Field of Classification Search
CPC ..... H01Q 21/22; H01Q 1/36; H01Q 1/247; H01Q 1/523; H01Q 3/38
See application file for complete search history.

(56) References Cited

U.S. PATENT DOCUMENTS

| | | | | |
|---|---|---|---|---|
| 3,441,937 A * | 4/1969 | Clasby | H01Q 9/27 | 343/895 |
| 4,015,264 A * | 3/1977 | Koerner | H01Q 9/27 | 343/725 |
| 6,452,568 B1 * | 9/2002 | Zidek | H01O 1/36 | 343/700 MS |
| 6,853,351 B1 * | 2/2005 | Mohuchy | H01Q 9/27 | 343/700 MS |
| 7,889,151 B1 * | 2/2011 | Brock | H01Q 9/27 | 343/700 MS |

* cited by examiner

*Primary Examiner* — Hoang V Nguyen
(74) *Attorney, Agent, or Firm* — Sand, Sebolt & Wernow LPA

(57) ABSTRACT

A dual mode array antenna including a ground plane, a plurality of antenna elements, a tuning mechanism for tuning the array antenna to a resonant frequency, and a base defining a cavity having a depth that is less than half of a wavelength at an upper frequency of the array antenna is disclosed. Each of the plurality of antenna elements includes at least one spiral arm and each of the plurality of antenna elements is embedded in the cavity. The dual mode array antenna operates between the upper frequency and a lower frequency and may operate in one or more resonant frequencies.

20 Claims, 9 Drawing Sheets

DUAL MODE ARRAY ANTENNA

STATEMENT OF GOVERNMENT INTEREST

This invention was made with government support under Contract No. FA8620-11-G-4029/0054 awarded by the U.S. Air Force. The government has certain rights in the invention.

BACKGROUND

Technical Field

The present disclosure relates generally to antennas. More particularly, the present disclosure relates to a circularly polarized array antenna. Specifically, the present disclosure relates to a dual mode array antenna including a plurality of cavity-embedded antenna elements with at least one spiral arm and operable in one or more resonant frequencies.

Background Information

An antenna is operable as a transducer that converts radio frequency electric current to electromagnetic waves that are then radiated into space. The electric field or "E" plane determines the polarization or orientation of the radio waves. In general, most antennas radiate either linear or circular polarization, but may also be elliptically polarized.

A linear polarized antenna radiates wholly in one plane containing the direction of propagation. In a circular polarized antenna, the plane of polarization rotates in a circle making one complete revolution during one period of the wave. If the rotation is clockwise looking in the direction of propagation, the sense is called right-hand-circular (RHC). If the rotation is counterclockwise looking in the direction of propagation, the sense is called left-hand-circular (LHC).

An antenna is said to be vertically polarized (linear) when its electric field is perpendicular to the Earth's surface. An example of a vertical antenna is a broadcast tower for AM radio or the "whip" antenna on an automobile. Horizontally polarized (linear) antennas have their electric field parallel to the Earth's surface. Television transmissions in the USA use horizontal polarization.

A circular polarized wave radiates energy in both the horizontal and vertical planes and all planes in between. The difference, if any, between the maximum and the minimum peaks as the antenna is rotated through all angles, is called the axial ratio or ellipticity and is usually specified in decibels (dB). If the axial ratio is near 0 dB, the antenna is said to be circular polarized. If the axial ratio is greater than 1 or 2 dB, the polarization is often referred to as elliptical.

Phased array antenna systems have long been used for both transmission and reception of signal waves in a variety of applications. Dimensional requirements of phased array antenna systems are typical design parameters which may affect the cost and performance of the phased array antenna systems. Exemplary dimensional requirements may include designing phased array antenna systems that are tolerant to electrically small and varying volume constraints. If the phased array antenna systems are not tolerant to electrically small and varying volume constraints, the performance of the phased array antenna systems is negatively affected.

SUMMARY

Issues continue to exist with phased array antennas that are tolerant to electrically small and varying volume constraints. The present disclosure addresses these and other issues by providing an array antenna that is tolerant to electrically small and varying volume constraints. The present disclosure further addresses these and other issues by providing a dual mode array antenna including a plurality of cavity-embedded antenna elements with at least one spiral arm and operable in one or more resonant frequencies.

In accordance with one aspect, an exemplary embodiment of the present disclosure may provide a dual mode array antenna comprising a ground plane, a plurality of antenna elements; wherein each of the plurality of antenna elements includes at least one spiral arm, a tuning mechanism for tuning the array antenna to a resonant frequency, a base defining a cavity having a depth that is less than half of a wavelength above the ground plane at an upper frequency of the array antenna; wherein the plurality of antenna elements is embedded in the cavity; and wherein the dual mode array antenna operates between the upper frequency and a lower frequency. In one embodiment, the resonant frequency is a first resonant frequency and the dual mode array antenna operates in at least one of the first resonant frequency and a second resonant frequency.

In one embodiment, the tuning mechanism utilizes capacitive tuning. In one embodiment, the at least one spiral arm spirals from a first end to a second terminal end and the tuning mechanism is a vertical plate operably coupled to the terminal second end of the at least one spiral arm. The at least one spiral arm is parallel to the ground plane and the vertical plate is perpendicular to the ground plane. In one embodiment, the array antenna further comprises a substrate including a top surface defining a horizontal plane and a side surface defining a vertical plane. The at least one spiral arm is positioned on the horizontal plane and the vertical plate is positioned on the vertical plane. The substrate may be substantially cube-shaped. In one embodiment, the dual mode array antenna comprises a bandwidth of at least approximately 5:1. In one embodiment, the tuning mechanism is a series inductive loading to the ground plane. In one embodiment, the cavity is symmetrical.

In one embodiment, the wavelength is a first wavelength and the depth of the cavity is approximately equal to or less than one tenth of a second wavelength above the ground plane at the lower frequency.

In one embodiment, the wavelength is a first wavelength and the dual mode array antenna further comprises a spacing distance between each of the plurality of antenna elements that is at most a half of a second wavelength at the upper frequency of the array antenna where the spacing distance prevents grating lobes.

In one embodiment, the at least one spiral arm includes a plurality of spiral arms and the array antenna further comprises an excitation value of the array antenna that maintains a relative phase of ninety degrees between each of the plurality of spiral arms.

In one embodiment, the at least one spiral arm includes four spiral arms and the array antenna further comprises a first ninety degree hybrid coupler operably engaged with two of the four spiral arms, a second ninety degree hybrid coupler operably engaged with the other two of the four spiral arms, and a one hundred eighty degree hybrid coupler operably engaged with the first ninety degree hybrid coupler and the second ninety degree hybrid coupler. In one embodiment, the first ninety degree coupler further comprises a first isolation port, the second ninety degree hybrid coupler further comprises a second isolation port, and reflected power is terminated via resistive match termination at the first isolation port and the second isolation port.

In accordance with another aspect, an exemplary embodiment of the present disclosure may provide a method of operating a dual mode array antenna comprising tuning the array antenna to a resonant frequency and radiating energy from a plurality of antenna elements between an upper frequency and a lower frequency. Each of the plurality of antenna elements includes at least one spiral arm and each of the plurality of antenna elements is embedded in a cavity defined by a base. A depth of the cavity is less than half of a wavelength at the upper frequency of the array antenna.

In one embodiment, the wavelength is a first wavelength; and wherein the depth of the cavity is approximately equal to or less than one tenth of a second wavelength above the ground plane at the lower frequency.

In one embodiment, the method further includes operably engaging a vertical plate to each of the at least one spiral arm. In one embodiment, tuning the array to the resonant frequency is accomplished at least in part, through capacitive tuning via the vertical plate.

In one embodiment, the at least one spiral arm includes a plurality of spiral arms and the method further includes exciting the plurality of spiral arms with signals such that the signals maintain a relative phase of ninety degrees between each of the plurality of spiral arms.

In one embodiment, the at least one spiral arm includes four spiral arms and the method further includes operably engaging a first ninety degree hybrid coupler with two of the four spiral arms; wherein the first ninety degree hybrid coupler includes a first isolation port; operably engaging a second ninety degree hybrid coupler with the other two of the four spiral arms; wherein the first ninety degree hybrid coupler includes a second isolation port; operably engaging a one hundred eighty degree hybrid coupler with the first ninety degree hybrid coupler and the second ninety degree hybrid coupler; and terminating reflected power via resistive match termination at the first isolation port and the second isolation port.

In accordance with another aspect, an exemplary embodiment of the present disclosure may provide a dual mode array antenna including a ground plane, a plurality of antenna elements, a tuning mechanism for tuning the array antenna to a resonant frequency, and a base defining a cavity having a depth that is less than half of a wavelength at an upper frequency of the array antenna. Each of the plurality of antenna elements includes at least one spiral arm and each of the plurality of antenna elements is embedded in the cavity. The dual mode array antenna operates between the upper frequency and a lower frequency and may operate in one or more resonant frequencies.

BRIEF DESCRIPTION OF THE SEVERAL VIEWS OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1:
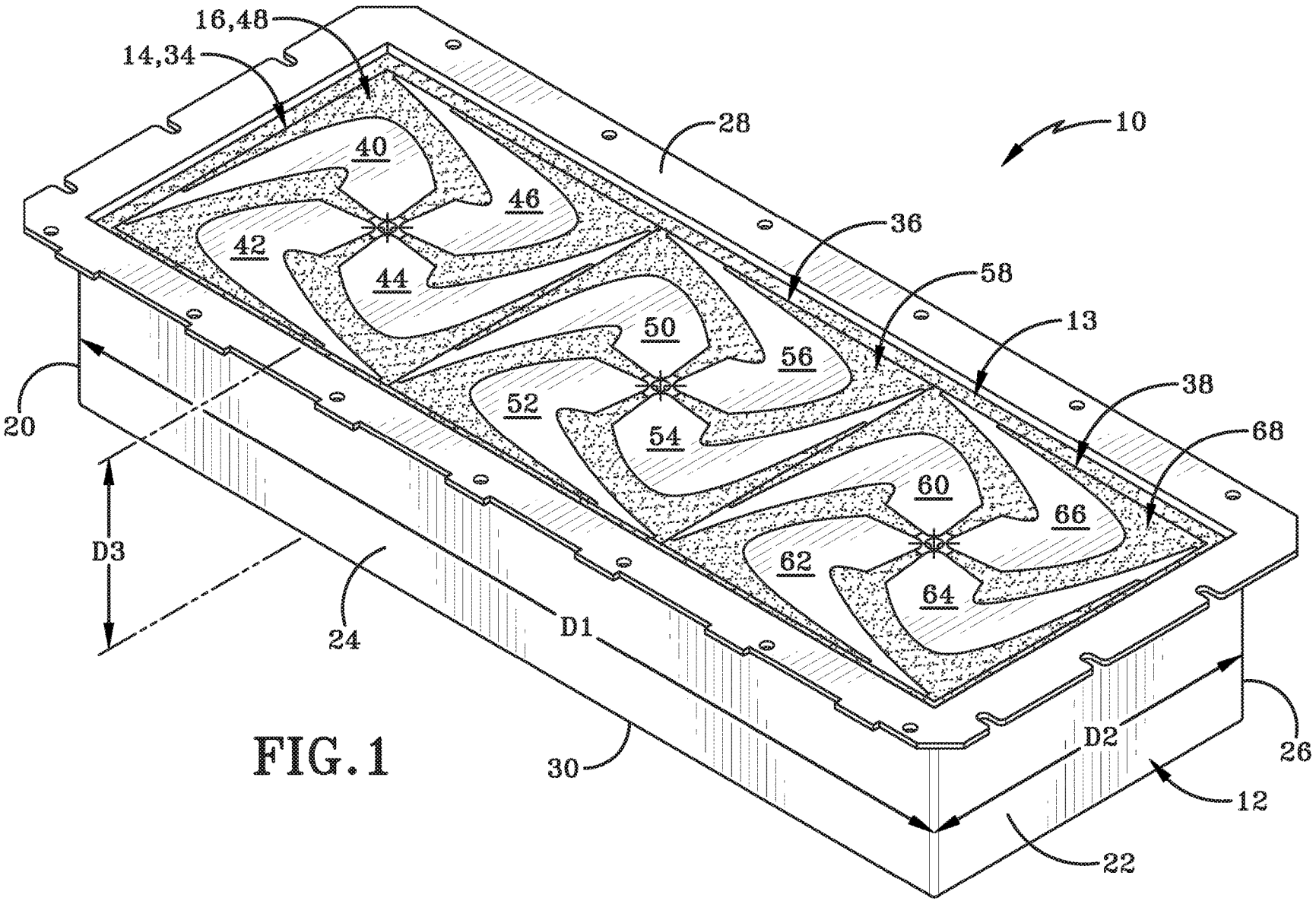
FIG. 1 is a schematic perspective view of an array antenna having a plurality of antenna elements according to one embodiment.
Figure 7:
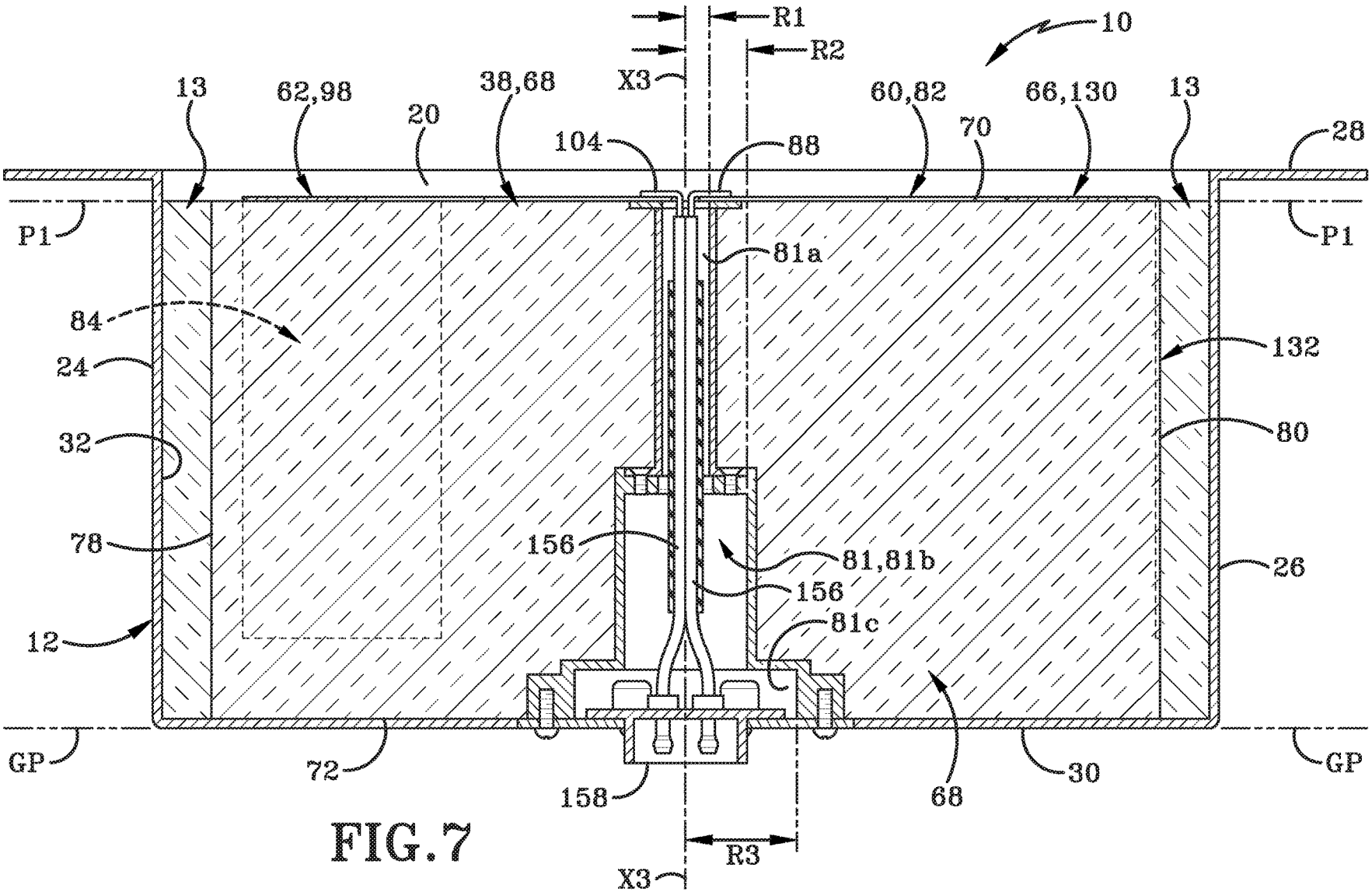
FIG. 7 is a cross-section view taken along line 7-7 of FIG. 2.
Figure 8:
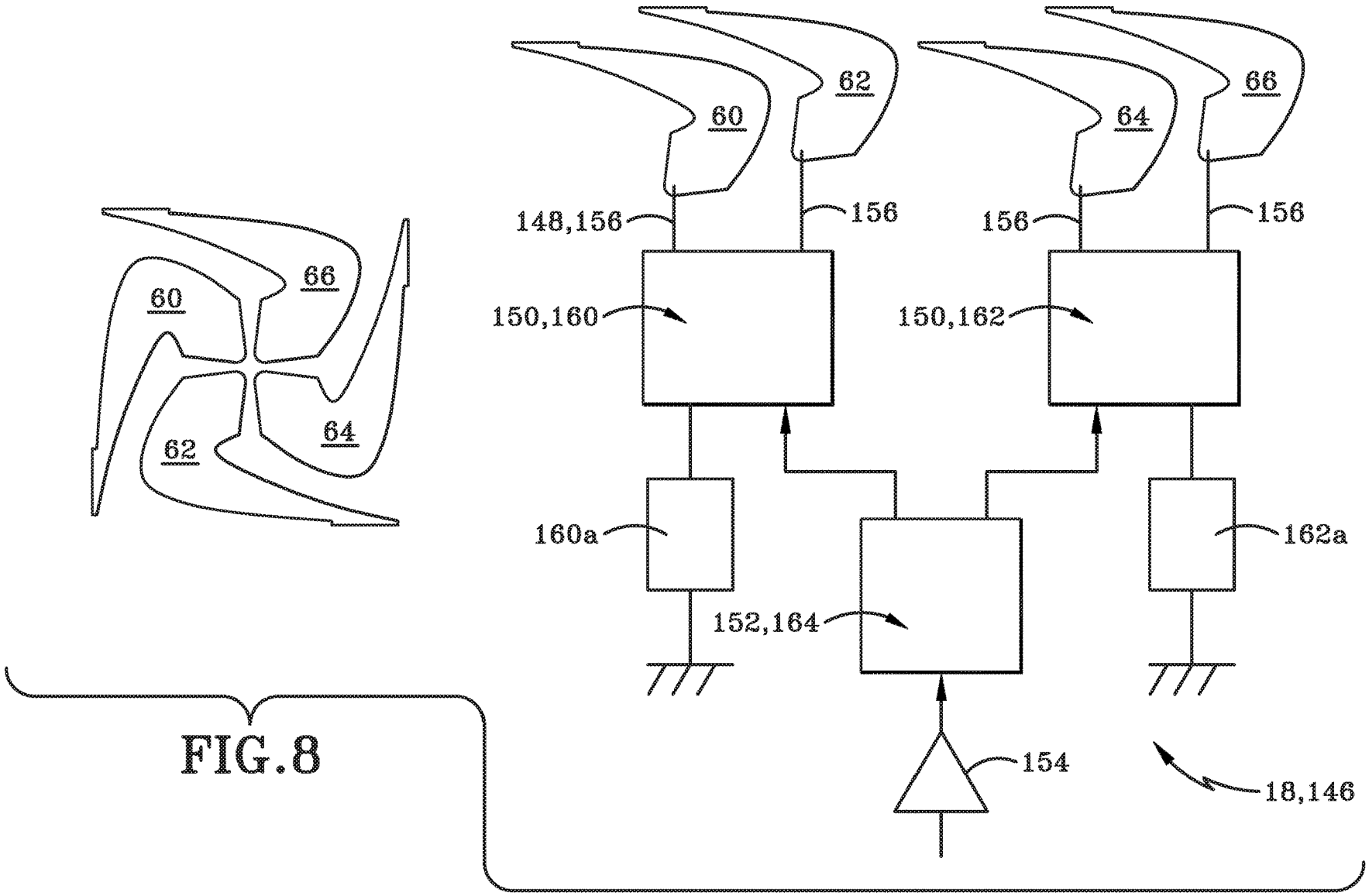
FIG. 8 is a top plan view of spiral arms of an antenna element and one embodiment of a combiner network operatively connected to the spiral arms of the antenna element.

Referring to FIG. 1-FIG. 8, a dual mode array antenna is shown generally at 10. FIG. 1 depicts that the array antenna 10 may include a base 12, a lining 13, at least one antenna element 14, at least one substrate 16, and a feed network 18 (FIG. 8).

With reference to FIG. 1 through FIG. 8, and in one particular embodiment, the base 12 includes a first end wall 20 opposite a second end wall 22 defining a longitudinal direction therebetween, a first side wall 24 opposite a second side wall 26 defining a transverse direction therebetween, and a top mounting flange 28 opposite a bottom wall 30 defining a vertical direction therebetween. In one embodiment, the bottom wall 30 may also serve as a ground plane GP of the array antenna 10. Base 12 may be a substantially rigid member formed from any one of a variety or plurality of materials that impart rigidity to the structure of base 12 without impinging or degrading transmitted or received signals effectuated by the antenna 10. Base 12 includes a cavity 32 defined by the first end wall 20, the second end wall 22, the first side wall 24, the second side wall 26, and the bottom wall 30. The bottom wall 30 defines a first aperture 30*a*, a second aperture 30*b*, and a third aperture 30*c*. In one embodiment, the cavity 32 is configured to have a symmetrical volume and is configured to receive the plurality of antenna elements 14. In one embodiment, the plurality of antenna elements 14 is operably engaged with the base 12 as further described below. In one example the base is a three dimensional structure having a length, width and height that can be rectangular or cube-shaped. In a further embodiment the base shape can vary to accommodate the design criteria and application such as deployment in small form factor locations.

In one embodiment, the first end wall 20 is spaced a distance D1 from the second end wall 22. In one example, the distance D1 is approximately 37 inches; however, the distance D1 may be any suitable distance. In one embodiment, the first side wall 24 is spaced a distance D2 from the second side wall 26. In one example, the distance D2 is approximately 13 inches; however, the distance D2 may be any suitable distance. In one embodiment, the top 28 is spaced a distance D3 from the bottom wall 30. In one example, the distance D3 is approximately 7 inches; however, the distance D3 may be any suitable distance.

FIG. 1 depicts that the lining 13 lines the inner portions of the first end wall 20, the second end wall 22, the first side wall 24, and the second side wall 26 within the cavity 32. In one embodiment, the lining 13 is foam having a permittivity that does not inhibit or degrade the signals radiated from the at least one antenna element 14. In one particular embodiment, the lining 13 has a permittivity of about one; however, the permittivity of the lining 13 may vary depending upon the application's specific needs implemented by the array antenna 10. The permittivity of the lining 13 may be optimized utilizing modeling software that would enable the array antenna 10 to determine different perceptivities that could be applied to desired applications. In one embodiment, the lining 13 is a foam commercially available for sale such as ROHACELL, however, any other suitable material with a permittivity close to that of air may be utilized. In one embodiment, the lining 13 is intended to absorb vibration in airborne applications; however, the lining 13 may be configured and used for any suitable applications.

With reference to FIG. 1 through FIG. 8, and in accordance with one embodiment of the present disclosure, the array antenna 10 includes a first antenna element 34, a second antenna element 36, and a third antenna element 38. The first antenna element 34 includes a first spiral arm 40, a second spiral arm 42, a third spiral arm 44, and a fourth spiral arm 46. In one embodiment, each of the first spiral arm 40, the second spiral arm 42, the third spiral arm 44, and the fourth spiral arm 46 are configured to be axially symmetric about their own axis; however, each of the first spiral arm 40, the second spiral arm 42, the third spiral arm 44, and the fourth spiral arm 46 may be configured in any suitable manner. The first spiral arm 40, the second spiral arm 42, the third spiral arm 44, and the fourth spiral arm 46 are supported by, and conform to, a first substrate 48. The second antenna element 36 includes a first spiral arm 50, a second spiral arm 52, a third spiral arm 54, and a fourth spiral arm 56. In one embodiment, each of the first spiral arm 50, the second spiral arm 52, the third spiral arm 54, and the fourth spiral arm 56 are configured to be axially symmetric about their own axis; however, each of the first spiral arm 50, the second spiral arm 52, the third spiral arm 54, and the fourth spiral arm 56 may be configured in any suitable manner. The first spiral arm 50, the second spiral arm 52, the third spiral arm 54, and the fourth spiral arm 56 are supported by, and conform to, a second substrate 58. The third antenna element 38 includes a first spiral arm 60, a second spiral arm 62, a third spiral arm 64, and a fourth spiral arm 66. The first spiral arm 60, the second spiral arm 62, the third spiral arm 64, and the fourth spiral arm 66 are supported by, and conform to, a third substrate 68. In one embodiment, each of the first spiral arm 60, the second spiral arm 62, the third spiral arm 64, and the fourth spiral arm 66 are configured to be axially symmetric about their own axis; however, each of the first spiral arm 60, the second spiral arm 62, the third spiral arm 64, and the fourth spiral arm 66 may be configured in any suitable manner.

The configuration of the first spiral arm 40, the second spiral arm 42, the third spiral arm 44, the fourth spiral arm 46, and the first substrate 48 of the first antenna element 34 is substantially identical to the configuration of the first spiral arm 50, the second spiral arm 52, the third spiral arm 54, the fourth spiral arm 56, and the second substrate 58 of the second antenna element 36 and the configuration of the first spiral arm 60, the second spiral arm 62, the third spiral arm 64, the fourth spiral arm 66, and the third substrate 68 of the third antenna element 38, and, therefore, only the configuration of the first spiral arm 60, the second spiral arm 62, the third spiral arm 64, the fourth spiral arm 66, and the third substrate 68 of the third antenna element 38 will be discussed further herein.

With reference to FIG. 5-FIG. 8, the third substrate 68 includes a top surface 70 spaced vertically from a bottom surface 72, a first side surface 74 spaced longitudinally from a second side surface 76, and a third side surface 78 spaced transversely from a fourth side surface 80. The third substrate 68 includes a longitudinal central axis X1 extending from the first side surface 74 to the second side surface 76, a transverse central axis X2 extending from the third side surface 78 to the fourth side surface 80, and a vertical central axis X3 extending form the top surface 70 to the bottom surface 72. The third substrate 68 further includes a passage 81 defined by the third substrate and extending from the top surface 70 to the bottom surface 72 and is positioned generally along the central vertical axis X3. In one embodiment, the passage 81 includes a first portion 81*a*, a second portion 81*b*, and a third portion 81*c*. The first portion 81*a* includes a first radius R1, the second portion includes a second radius R2, and the third portion includes a third radius R3. In one embodiment, the first radius R1 is smaller than the second radius R2, and the second radius R2 is smaller than the third radius R3; however, the radii R1, R2, and R3 may be any suitable radii. The passage 81 may be configured to allow an electrical connection between the antenna element 38 and the feed network 18 as further described below. In one embodiment, the third substrate 68 is made of foam; however, the third substrate 68 may be made out of any suitable material. In one example, the third substrate 68 is ROHACELL, however, any other suitable foam may be utilized.

Figure 5:
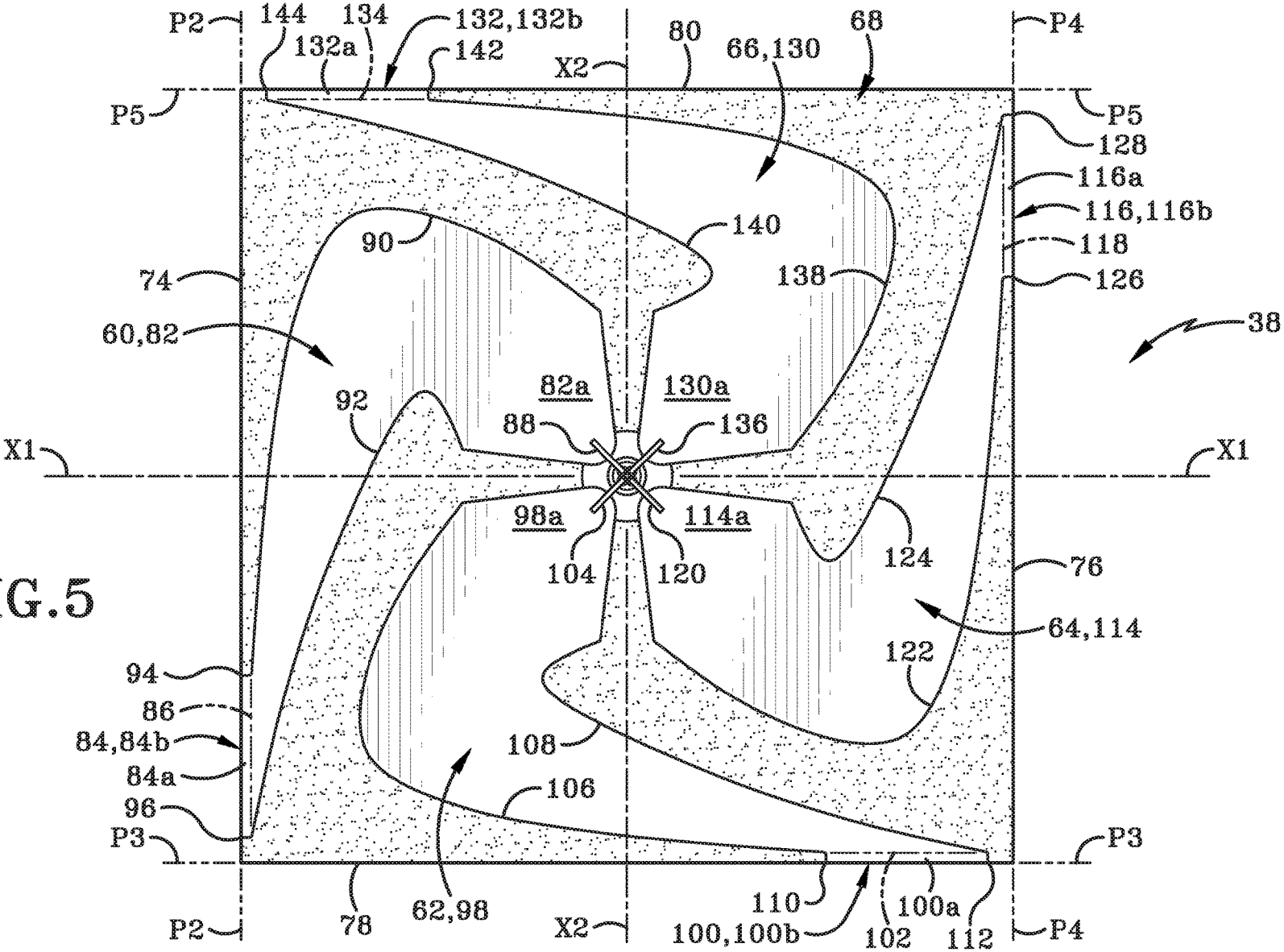
FIG. 5 is a top plan view of the removed antenna element of FIG. 4.
Figure 6:
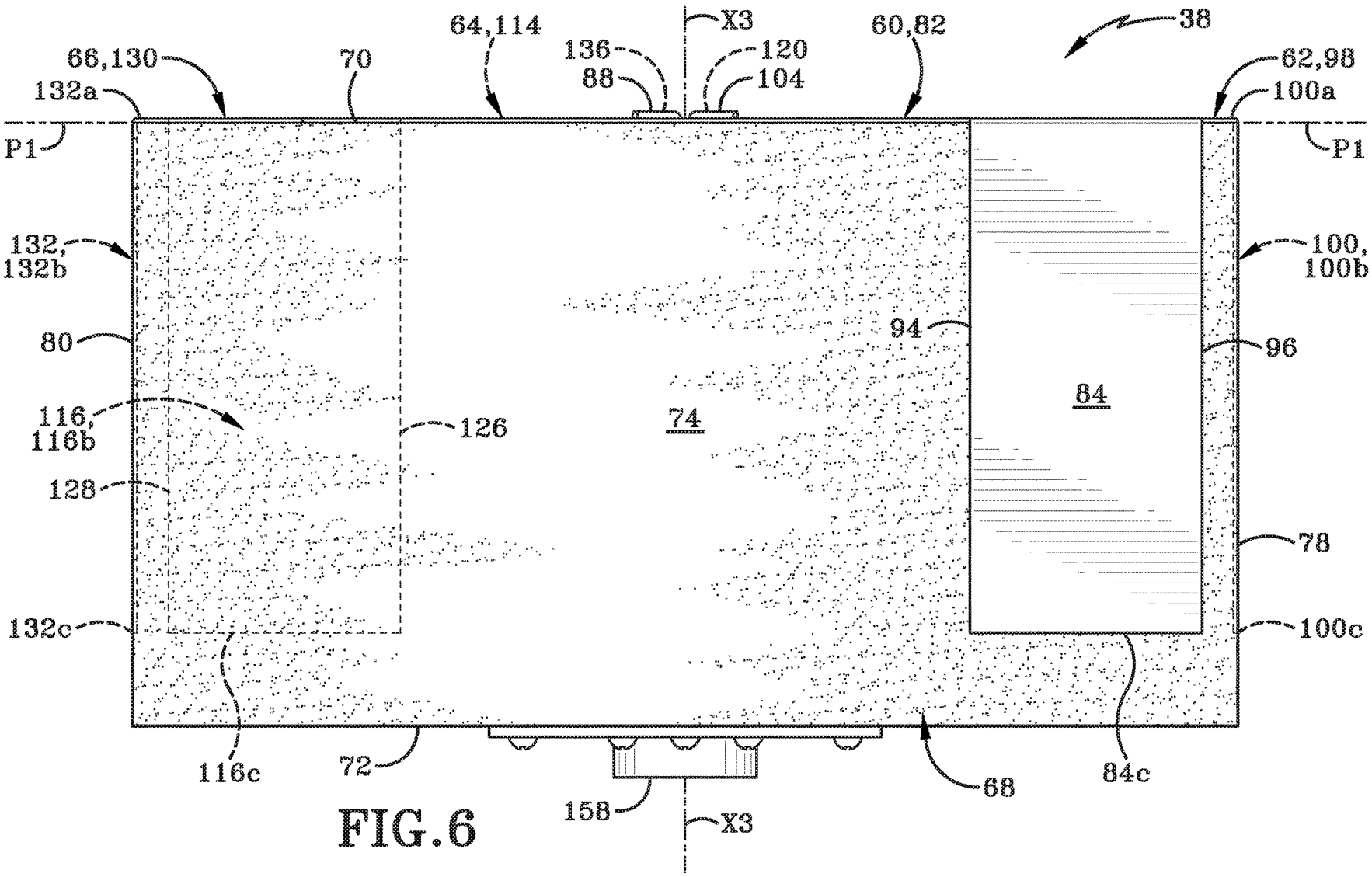
FIG. 6 is a side elevation view of the removed antenna element of FIG. 4.

In one embodiment, the first spiral arm 60 includes a first portion 82 operably engaged with a second portion 84, which may also be referred to as a tuning mechanism, at a transition region 86, which is shown as a dashed line in FIG. 5. The first spiral arm 60 further includes a first feed point 88 operably engaged with the first portion 82. The first portion 82 includes a spiraling first edge 90 and a spiraling second edge 92. The first edge 90 is spaced apart from the second edge 92 and a width of the first portion 82 of the first spiral arm 60 is between the first edge 90 and the second edge 92. The first portion 82 includes a generally triangular region 82*a* extending away from the first feed point 88. The first portion 82 winds in an arcuate manner from the generally triangular region 82*a* to the transition region 86 between the first portion 82 and the second portion 84. As the first portion 82 spirals from the generally triangular region 82*a* to the transition region 86, the width of the first portion 82 narrows. Stated otherwise, the width of the first portion 82 between the first edge 90 and the second edge 92 is wider or greater near the generally triangular region 82*a* than it is proximate the transition region 86. In one embodiment, the first portion 82 is positioned on a horizontal plane P1 defined by the top surface 70 of the third substrate 68. The second portion 84 of the first spiral arm 60 includes a first edge 94 and a second edge 96. The first edge 94 is spaced apart from the second edge 96 and a width of the second portion 84 of the first spiral arm 60 is between the first edge 94 and the second edge 96. The second portion 84 includes a first generally rectangular region 84*a* extending generally perpendicular from the transition region 86. In one embodiment, the generally rectangular region 84*a* is positioned on the horizontal plane P1. The second portion 84 includes a second generally rectangular region 84*b* which folds away from the first generally rectangular region 84*a* and extends generally perpendicular to the first generally rectangular region 84*a*. In one embodiment, the second generally rectangular region 84*b* is positioned on a vertical first plane P2 defined by the first side surface 74 and between the longitudinal axis X1 and the third side surface 78. Although particular dimensions and configurations of the first spiral arm 60 have been identified, it is to be entirely understood that the first spiral arm 60 may have any suitable dimensions and have any suitable configurations.

In one embodiment, the second spiral arm 62 includes a first portion 98 operably engaged with a second portion 100, which may also be referred to as a tuning mechanism, at a transition region 102, which is shown as a dashed line in FIG. 5. The second spiral arm 62 further includes a second feed point 104 operably engaged with the first portion 98. The first portion 98 includes a spiraling first edge 106 and a spiraling second edge 108. The first edge 106 is spaced apart from the second edge 108 and a width of the first portion 98 of the second spiral arm 62 is between the first edge 106 and the second edge 108. The first portion 98 includes a generally triangular region 98*a* extending away from the second feed point 104. The first portion 98 winds in an arcuate manner from the generally triangular region 98*a* to the transition region 102 between the first portion 98 and the second portion 100. As the first portion 98 spirals from the generally triangular region 98*a* to the transition region 102, the width of the first portion 98 narrows. Stated otherwise, the width of the first portion 98 between the first edge 106 and the second edge 108 is wider or greater near the generally triangular region 98*a* than it is proximate the transition region 102. In one embodiment, the first portion 98 is positioned on the horizontal plane P1. The second portion 100 of the second spiral arm 62 includes a first edge 110 and a second edge 112. The first edge 110 is spaced apart from the second edge 112 and a width of the second portion 100 of the second spiral arm 62 is between the first edge 110 and the second edge 112. The second portion 100 includes a first generally rectangular region 100*a* extending generally perpendicular from the transition region 102. In one embodiment, the generally rectangular region 100*a* is positioned on the horizontal plane P1. The second portion 100 includes a second generally rectangular region 100*b* which folds away from the first generally rectangular region 84*a* and extends generally perpendicular to the first generally rectangular region 100*a*. In one embodiment, the second generally rectangular region 100*b* is positioned on a vertical second plane P3 defined by the third side surface 78 and between the transverse axis X2 and the second side surface 76. Although particular dimensions and configurations of the second spiral arm 62 have been identified, it is to be entirely understood that the second spiral arm 62 may have any suitable dimensions and have any suitable configurations.

In one embodiment, the third spiral arm 64 includes a first portion 114 operably engaged with a second portion 116, which may also be referred to as a tuning mechanism, at a transition region 118, which is shown as a dashed line in FIG. 5. The third spiral arm 64 further includes a third feed point 120 operably engaged with the first portion 114. The first portion 114 includes a spiraling first edge 122 and a spiraling second edge 124. The first edge 122 is spaced apart from the second edge 124 and a width of the first portion 114 of the third spiral arm 64 is between the first edge 122 and the second edge 124. The first portion 114 includes a generally triangular region 114*a* extending away from the third feed point 120. The first portion 114 winds in an arcuate manner from the generally triangular region 114*a* to the transition region 118 between the first portion 114 and the second portion 116. As the first portion 114 spirals from the generally triangular region 114*a* to the transition region 118, the width of the first portion 114 narrows. Stated otherwise, the width of the first portion 114 between the first edge 122 and the second edge 124 is wider or greater near the generally triangular region 114*a* than it is proximate the transition region 118. In one embodiment, the first portion 114 is positioned on the horizontal plane P1. The second portion 116 of the third spiral arm 40 includes a first edge 126 and a second edge 128. The first edge 126 is spaced apart from the second edge 128 and a width of the second portion 116 of the third spiral arm 64 is between the first edge 126 and the second edge 128. The second portion 116 includes a first generally rectangular region 116*a* extending generally perpendicular from the transition region 118. In one embodiment, the generally rectangular region 118*a* is positioned on the horizontal plane P1. The second portion 116 includes a second generally rectangular region 116*b* which folds away from the first generally rectangular region 116*a* and extends generally perpendicular to the first generally rectangular region 116*a*. In one embodiment, the second generally rectangular region 116*b* is positioned on a vertical third plane P4 defined by the second side surface 74 and between the longitudinal axis X1 and the third side surface 78. Although particular dimensions and configurations of the first spiral arm 60 have been identified, it is to be entirely understood that the first spiral arm 60 may have any suitable dimensions and have any suitable configurations.

In one embodiment, the fourth spiral arm 66 includes a first portion 130 operably engaged with a second portion 132, which may also be referred to as a tuning mechanism, at a transition region 134, which is shown as a dashed line in FIG. 5. The fourth spiral arm 66 further includes a fourth feed point 136 operably engaged with the first portion 130. The first portion 130 includes a spiraling first edge 138 and a spiraling second edge 140. The first edge 138 is spaced apart from the second edge 140 and a width of the first portion 130 of the fourth spiral arm 66 is between the first edge 138 and the second edge 140. The first portion 130 includes a generally triangular region 130*a* extending away from the fourth feed point 136. The first portion 130 winds in an arcuate manner from the generally triangular region 130*a* to the transition region 134 between the first portion 130 and the second portion 132. As the first portion 130 spirals from the generally triangular region 130*a* to the transition region 134, the width of the first portion 130 narrows. Stated otherwise, the width of the first portion 130 between the first edge 138 and the second edge 140 is wider or greater near the generally triangular region 130*a* than it is proximate the transition region 134. In one embodiment, the first portion 130 is positioned on the horizontal plane P1. The second portion 132 of the fourth spiral arm 66 includes a first edge 142 and a second edge 144. The first edge 142 is spaced apart from the second edge 144 and a width of the second portion 132 of the fourth spiral arm 66 is between the first edge 142 and the second edge 144. The second portion 132 includes a first generally rectangular region 132*a* extending generally perpendicular from the transition region 134. In one embodiment, the generally rectangular region 132*a* is positioned on the horizontal plane P1. The second portion 132 includes a second generally rectangular region 132*b* which folds away from the first generally rectangular region 132*a* and extends generally perpendicular to the first generally rectangular region 132*a*. In one embodiment, the second generally rectangular region 132*b* is positioned on a vertical fourth plane P5 defined by the fourth side surface 80 and between the transverse axis X2 and the first side surface 74. Although particular dimensions and configurations of the fourth spiral arm 62 have been identified, it is to be entirely understood that the fourth spiral arm 66 may have any suitable dimensions and have any suitable configurations.

Figure 2:
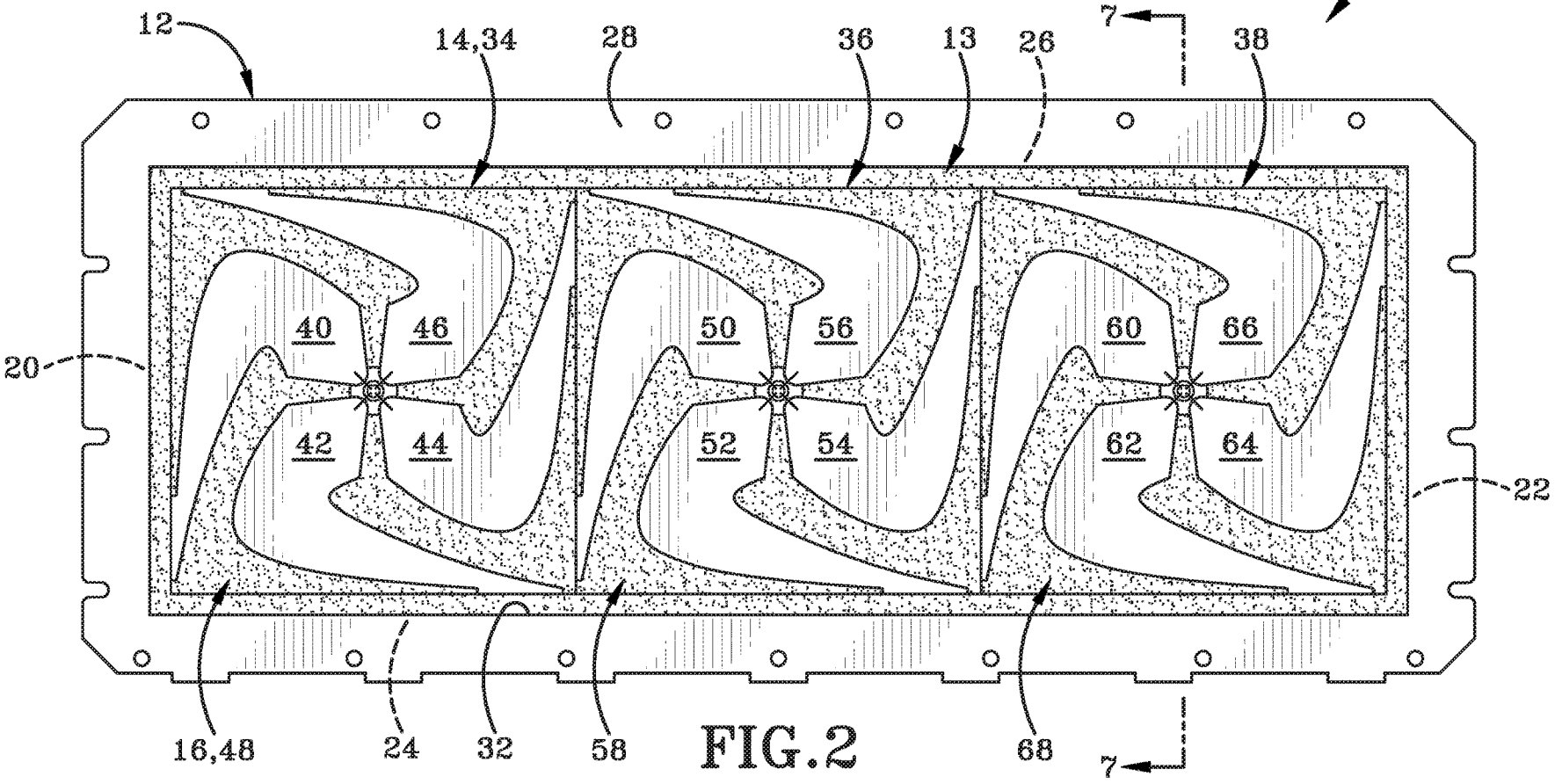
FIG. 2 is a top plan view of the array antenna of FIG. 1.
Figure 3:
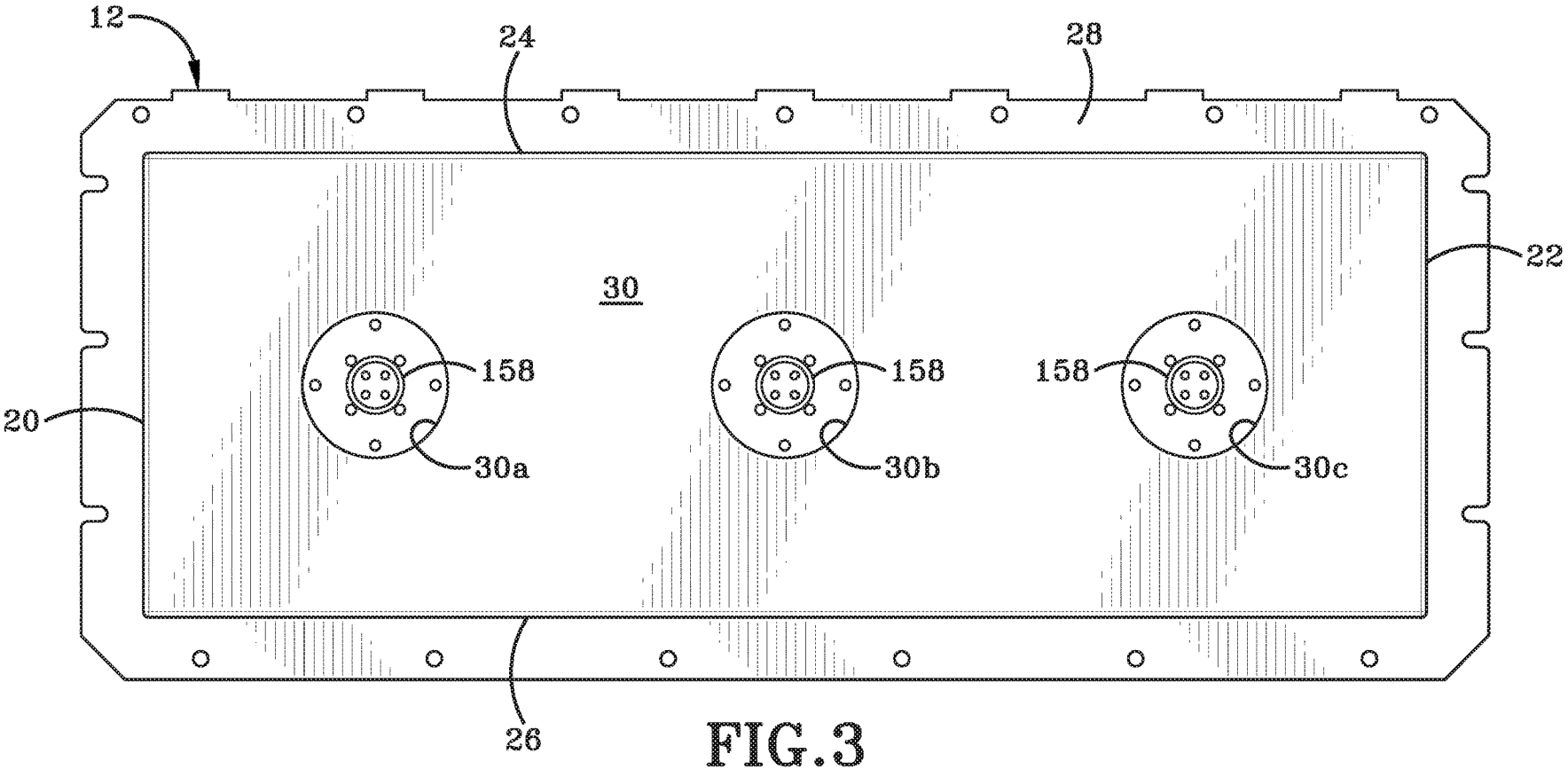
FIG. 3 is a bottom plan view of the array antenna of FIG. 1.
Figure 4:
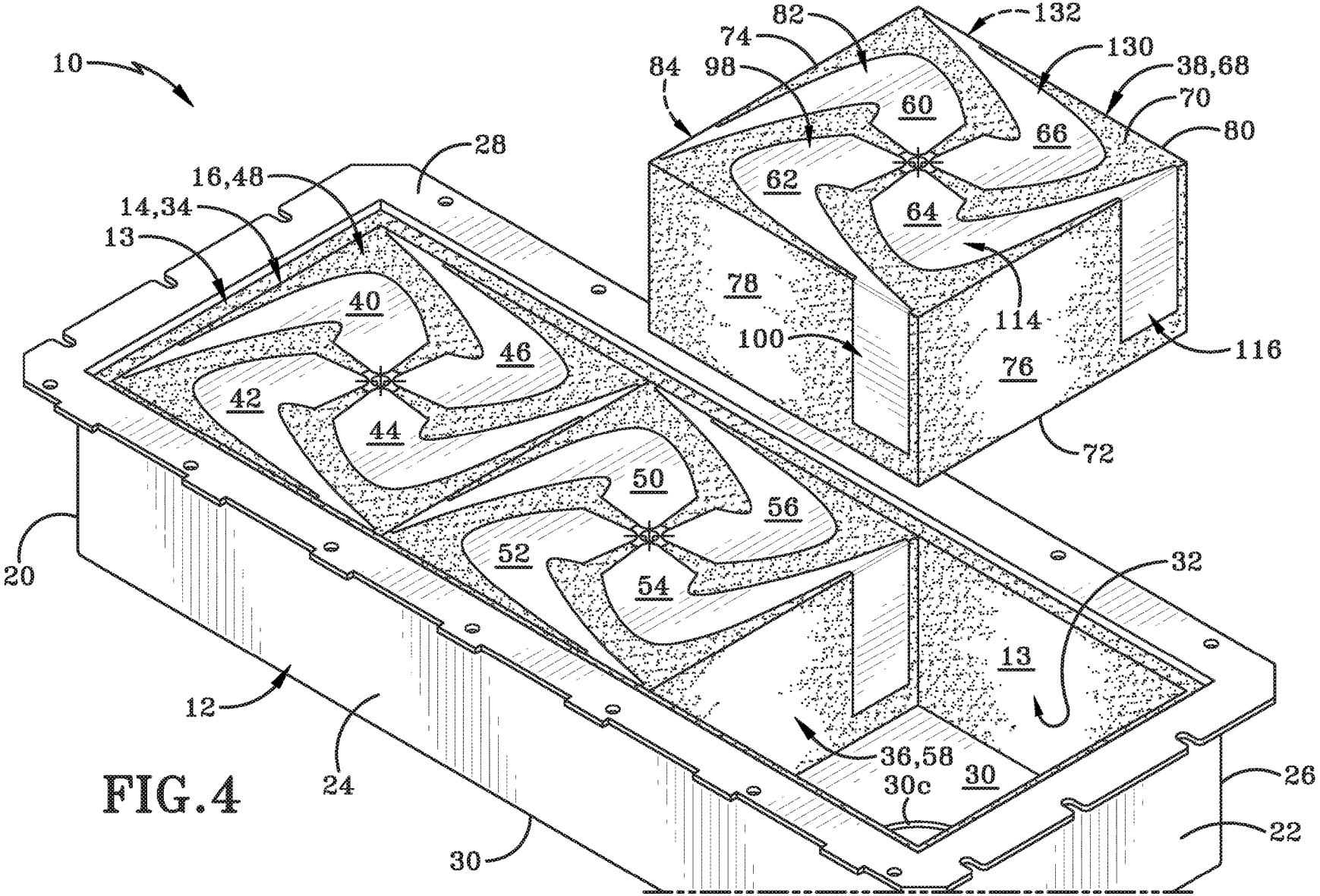
FIG. 4 is a schematic perspective view of the array antenna of FIG. 1 with one of the antenna elements removed from the array antenna.

In one embodiment, the first spiral arm 60 and the third spiral arm 64 form a first cross bow tie antenna configuration and the second spiral arm 62 and the fourth spiral arm 66 form a second cross bow tie antenna configuration. Stated otherwise, the first spiral arm 60, the second spiral arm 62, the third spiral arm 64, and the fourth spiral arm 66 form a crossed bowtie/spiral design array antenna 10 configuration. As such, the first feed point 88 and the third feed point 120 are vertically coplanar with one another and the second feed point 104 and the fourth feed point 136 are vertically coplanar with one another. In one embodiment, the first spiral arm 60, the second spiral arm 62, the third spiral arm 64, and the fourth spiral arm 66 are swept in a counterclockwise direction when viewed from the top as shown in FIG. 2. In a circular polarized antenna, the plane of polarization rotates in a circle making one complete revolution during one period of the wave. If the rotation is clockwise looking in the direction of propagation, the sense is called right-hand-circular (RHC). If the rotation is counterclockwise looking in the direction of propagation, the sense is called left-hand-circular (LHC). In this embodiment, the rotation is rotation is clockwise looking in the direction of propagation, and, therefore, the sense of the array antenna 10 is right-hand-circular (RHC). It is to be understood that the array antenna 10 could be configured such that the sense of the array antenna 10 is left-hand circular (LHC) by, inter alia, changing the sweep of the spiral arms 60, 62, 64, and 66.

In one embodiment, the first antenna element 34, the second antenna element 36, and the third antenna element 38 are positioned within the base 12 such that the first antenna element 34, the second antenna element 36, and the third antenna element 38 are longitudinally aligned with one another. In this embodiment, the third antenna element 38 is positioned such that the second side 76 is adjacent the lining 13 positioned on the second end wall 22 of the base 12. The second antenna element is positioned adjacent the third antenna element 38 and adjacent the first antenna element 34 and the first antenna element 34 is positioned adjacent the lining 13 positioned on the first end wall 20 of the base 12. As stated above, the first antenna element 34, the second antenna element 36, and the third antenna element 38 are substantially identical, and, therefore, the components of the first antenna element 34 and the second antenna element 36 are configured substantially identical to the components of the third antenna element 38, even though all of the components of the first antenna element 34 and the second antenna element 36 are not further described herein. Therefore, each of the first spiral arm 40, the second spiral arm 42, the third spiral arm 44, the fourth spiral arm 46 of the first antenna element 34, the first spiral arm 50, the second spiral arm 52, the third spiral arm 54, and the fourth spiral arm 56 of the second antenna element 36, and the first spiral arm 60, the second spiral arm 62, the third spiral arm 64, and the fourth spiral arm 66 of the third antenna element 38 are cavity-backed.

In one embodiment, the feed network 18 is a combiner network 146 including at least one feed line 148, at least one ninety degree hybrid coupler 150, at least one one hundred eighty degree hybrid coupler 152, and at least one an amplifier 154. The at least one feed line 148 is configured to electrically connect the at least one antenna element 14 to the feed network 18.

In one embodiment, the feed network 18 is connected to the first antenna element 34, the second antenna element 36, and the third antenna element 38 in a substantially identical manner, and, therefore, only the connection between the feed network 18 and the third antenna element 38 will be further described herein. In one embodiment, the at least one feed line 148 is a plurality of coaxial cables 156 which electrically connects the first spiral arm 60, the second spiral arm 62, the third spiral arm 64, and the fourth spiral arm 66 to the feed network 18.

With reference to FIG. 7 and FIG. 8, and in one particular embodiment, the coaxial cables 156 extend through the passage 81 of the third substrate 68 and are electrically connected to the first feed point 88, the second feed point 104, the third feed point 120, and the fourth feed point 136. The coaxial cables 156 are operably engaged with the third substrate 68 via a mount 158; however, the coaxial cables 156 may be operably engaged with the third substrate 68 in any suitable manner. In this embodiment, the first spiral arm 60, the second spiral arm 62, the third spiral arm 64, and the fourth spiral arm 66 are fed in a quadrature manner to reduce the effects of mutual coupling between the first spiral arm 60, the second spiral arm 62, the third spiral arm 64, and the fourth spiral arm 66. In this embodiment, the first spiral arm 60 and the second spiral arm 62 are connected to a first ninety degree hybrid coupler 160 and the third spiral arm 64 and the fourth spiral arm 66 are connected to a second ninety degree hybrid coupler 162. The first ninety degree hybrid coupler 160 includes an isolation port 160*a* where a resistive match termination occurs. The second ninety degree 162 hybrid coupler includes an isolation port 162*a* where a resistive match termination occurs. The first ninety degree hybrid coupler 160 and the second ninety degree hybrid coupler 162 are connected to a one hundred eighty degree hybrid coupler 164. The one hundred eighty degree hybrid coupler 164 is connected to an amplifier 166. As stated above, the first spiral arm 60, the second spiral arm 62, the third spiral arm 64, and the fourth spiral arm 66 are fed in a quadrature manner. In one embodiment, the first spiral arm 60 is fed a zero degree signal, the second spiral arm 62 is fed a ninety degree signal, the third spiral arm 64 is fed a one hundred eighty degree signal, and the fourth spiral arm 66 is fed a two hundred seventy degree signal.

In accordance with one aspect of the present disclosure, and in operation, the dual mode array antenna 10 operates simultaneously in dual modes and is configured to operate between an upper frequency and a lower frequency. In one embodiment, the bandwidth of the array antenna 10 is approximately 5:1; however, the bandwidth may be any suitable bandwidth. In one embodiment, the upper frequency is set when the dipole is a half wavelength above the ground plane 30. The dipole spacing from the ground plane 30 should typically not exceed a half wavelength because at a half wavelength the backward reflected electrical field toward ground plane 30 undergoes a one hundred eighty degree phase shift, followed by a one hundred eighty degree phase shift during the conducting surface reflection, followed by another one hundred eighty degree phase shift as the energy travels back toward the radiating surface. At this point, the energy is one hundred eighty degrees out of phase from the excitation, causing destructive interference and a null in radiation at broadside. When the spacing of the dipole is less than a half wavelength, there is typically no complete destructive interference at broadside. If there is an absorber on the ground plane 30, then there is a one half power loss (i.e., 3 decibel (dB)) and there is no upper frequency cutoff. Another limitation of the upper frequency is due to spacing between the antenna elements 14 in the array antenna 10. When the spacing is more than half a wavelength, then there are grating lobes (i.e., two beams) radiating when the array antenna 10 is scanned to the sides. In one embodiment, the lower frequency cutoff occurs when the antenna is one tenth of a wavelength, or less, above the ground plane 30 where the radiation efficiency is poor. In one embodiment, the base 12 is made of metal, and the array antenna 10 is embedded in the metal base 12, so the lower frequency cutoff is also determined when the cavity width is one tenth of a wavelength, or when the inductance of the metal cavity shorts out the array antenna 10.

In one embodiment, current is fed from the feed network 18 to each of the spiral arms 40, 42, 44, 46, 50, 52, 54, 56, 60, 62, 64, and 66, and, since the current flows through the arms in a substantially identical manner, only current flowing through the first arm 60 of the third antenna element 38 will be further described herein. In this embodiment, the dual mode array antenna 10 operates in a first mode and a second mode. In one embodiment, the first mode is associated with a upper frequency and the second mode is associated with a lower frequency. In one embodiment, the dual more array antenna 10 operates simultaneously in the first mode and second mode; however, the dual mode array antenna 10 may operate separately in the first mode or second mode.

In one embodiment, the resonant frequencies are determined primarily by the length of the conductor, which, in this case, is the spiral arms of the antenna elements; however, the resonant frequencies may be affected by surrounding geometry, such as the cavity 32 to be either lower or higher than the length of conductor would have caused. In one embodiment, and when the array antenna 10 operates at one resonant frequency, the array antenna 10 is tuned utilizing capacitive vertical plates, which may also be referred to as capacitive tuners, and which, in one embodiment, is the second portion 84 of the first spiral arm 60, and the second portion of each respective spiral arm of the antenna elements 34, 36, 38. In one embodiment, and in order to tune the array antenna 10 to one resonant frequency, the capacitive loaded second portion 84 removes the reactance (i.e., out of phase) part of the currents at the tuned frequency, and allows a better match at that frequency, which enables radiation. In this embodiment, and since currents have weak radiation resistance (i.e. not inclined to radiate), the first spiral arm 60 of the array antenna 10 acts in a substantially identical manner to a transmission line, and currents flow from the first feed point 88 to the second generally rectangular region 84*b* back to the first feed point 88 similar to an inductor capacitor (LC) resonator where the currents in the inductor are opposite the currents in the capacitor, so the currents cancel and the match improves. The larger the capacitor, the lower in frequency the resonator will tune, but the resonator still will not tend to radiate. Therefore, the capacitance provided by the second portion 84 should be matched to a desired resonant frequency without bringing the resonant frequency too low. If the resonant frequency is brought too low, there is a dip in the gain (i.e. a large mismatch at the first feed point 88) in the mid frequency band of the array antenna 10, which is undesirable. The large reflections at the low end of the frequency band are brought to the isolation port 160*a* of the first ninety degree hybrid coupler 160 to avoid large reflections back at the amplifier 166 where a resistive match termination occurs. In one embodiment, the reflected power travels to the isolation ports 160*a* and 162*a* of the ninety degree hybrid couplers 160 and 162 when all of the spiral arms are symmetric and all the phases of the reflected signals are the reverse phases of the excitation phases.

In one embodiment, and when the array antenna 10 operates at one resonant frequency, the array antenna 10 is tuned utilizing series inductive loading to the ground plane 30. In this embodiment, the inductive-resistive loading from the second portion 84 to the ground plane 30 will avoid large reflections, however, in general, the actual power that radiates is lower than the case of utilizing LC tuning as described above.

In one embodiment, and when the array antenna 10 operates at one resonant frequency, the array antenna 10 utilizes the crossed bowtie/spiral design configuration. In this embodiment, the array antenna 10 is frequency independent, where the currents radiate well at a half a wavelength dipole. In this embodiment, most of the currents stay within a one fourth wavelength wave of the first feed point 88.

In one embodiment, two dual mode array antennas 10 are utilized to create a 6×1 array antenna (not shown) that is electrically small at the very low end of the frequency band. Therefore, the array factor beamwidth is still broad (i.e., +/− approximately forty-five degrees) at the low end of the frequency band. In order to steer the beam to angles greater than forty-five degrees, the phases are set to steer only to forty-five degrees because the beamwidth still allows radiation at larger angles. If the phases were set to larger steer angles, the array antenna patterns would begin to cancel each other (i.e., be out of phase).

In one embodiment, the dual mode array antenna 10 is a cavity-embedded array antenna including improved broadband match impedance and scanned radiation compared to conventional cavity-backed antennas. In one embodiment, the antenna elements 14 are placed in an array to achieve sufficient gain at various scan directions. This is due to consequent narrowing of the beam width and due to improved match impedance due to mutual coupling between neighboring antenna elements 14. In one embodiment, the array antenna 10 operates at a higher performance over a wider range of frequencies than conventional spiral antennas.

Figure 9:
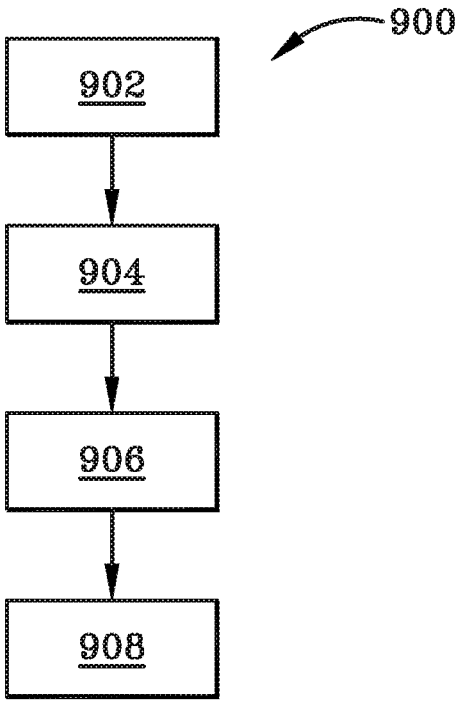
FIG. 9 is a flow chart depicting an exemplary method in accordance with one aspect of the present disclosure.

FIG. 9 depicts a method of operating a dual mode array antenna in accordance with one aspect of the present disclosure generally at 900. The method 900 includes tuning the array antenna 10 to a resonant frequency and radiating energy from a plurality of antenna elements 14 between an upper frequency and a lower frequency; wherein each of the plurality of antenna elements 14 includes at least one spiral arm, and wherein each of the plurality of antenna element 14 is embedded in a cavity 32 defined by a base 12 having a depth that is less than half of a wavelength at the upper frequency of the array antenna 10, which is shown generally at 902. In one embodiment, the resonant frequency is a first resonant frequency and the method further comprises radiating energy from a plurality of antenna elements in at least one of the first resonant frequency and a second resonant frequency. The method 900 includes operably engaging a vertical plate, such as the second portion of the spiral arms as described above, to each of the at least one spiral arm, which is shown generally at 904. In one embodiment, tuning the antenna array 10 to one resonant frequency is accomplished at least in part, through capacitive tuning via the vertical plate. In one embodiment, the at least one spiral arm includes a plurality of spiral arms and the method 900 further includes exciting the plurality of spiral arms with signals such that the signals maintain a relative phase of ninety degrees between each of the plurality of spiral arms, which is shown generally at 906. In one embodiment, the at least one spiral arm includes four spiral arms and the method 900 further includes operably engaging a first ninety degree hybrid coupler 160 with two of the four spiral arms; wherein the first ninety degree hybrid coupler includes a first isolation port 160*a*; operably engaging a second ninety degree hybrid coupler 162 with the other two of the four spiral arms; wherein the first ninety degree hybrid coupler includes a second isolation port 162*a*; operably engaging a one hundred eighty degree hybrid coupler 164 with the first ninety degree hybrid coupler 160 and the second ninety degree hybrid coupler 162; and terminating reflected power via resistive match termination at the first isolation port 160*a* and the second isolation port 162*a*, which is shown generally at 908.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A dual mode array antenna comprising:

a ground plane;

a plurality of antenna elements; wherein each of the plurality of antenna elements includes at least one spiral arm;

a tuning mechanism for tuning the array antenna to a resonant frequency; and a base defining a cavity having a depth that is less than half of a wavelength above the ground plane at an upper frequency of the array antenna; wherein the plurality of antenna elements is embedded in the cavity; and wherein the dual mode array antenna operates between the upper frequency and a lower frequency.

2. The dual mode array antenna of claim 1, wherein the resonant frequency is a first resonant frequency; and wherein the dual mode array antenna operates in at least one of the first resonant frequency and a second resonant frequency.

3. The dual mode array antenna of claim 1, wherein the tuning mechanism is a capacitive tuner.

4. The dual mode array antenna of claim 3, further comprising:

a first end and a terminal second end of the at least one spiral arm; wherein the at least one spiral arm spirals from the first end to the second terminal end; and wherein the capacitive tuner is a vertical plate operably coupled to the terminal second end of the at least one spiral arm.

5. The dual mode array antenna of claim 4, wherein the at least one spiral arm is parallel to the ground plane and the vertical plate is perpendicular to the ground plane.

6. The dual mode array antenna of claim 4, further comprising:

a substrate including a top surface defining a horizontal plane and a side surface defining a vertical plane; wherein the at least one spiral arm is coplanar with the horizontal plane and the vertical plate is coplanar with the vertical plane.

7. The dual mode array antenna of claim 1, wherein the tuning mechanism is a series inductive loading to the ground plane.

8. The dual mode array antenna of claim 1, further comprising:

a bandwidth of the dual mode array antenna; wherein the bandwidth is approximately 5:1.

9. The dual mode array antenna of claim 8, wherein the wavelength is a first wavelength; and wherein the depth of the cavity is approximately equal to or less than one tenth of a second wavelength above the ground plane at the lower frequency.

10. The dual mode array antenna of claim 1, wherein each of the at least one spiral arm is axially symmetric.

11. The dual mode array antenna of claim 10, further comprising:

a symmetrical volume of the cavity.

12. The dual mode array antenna of claim 1, wherein the wavelength is a first wavelength; the dual mode array antenna further comprising:

a spacing distance between each of the plurality of antenna elements that is at most a half of a second wavelength at the upper frequency of the array antenna; wherein the spacing distance prevents grating lobes.

13. The dual mode array antenna of claim 1, wherein the at least one spiral arm includes a plurality of spiral arms; and wherein the array antenna further comprises:

an excitation value of the array antenna that maintains a relative phase of ninety degrees between each of the plurality of spiral arms.

14. The dual mode array antenna of claim 1, wherein the at least one spiral arm includes four spiral arms; and wherein the array antenna further comprises:

a first ninety degree hybrid coupler operably engaged with two of the four spiral arms;

a second ninety degree hybrid coupler operably engaged with the other two of the four spiral arms; and a one hundred eighty degree hybrid coupler operably engaged with the first ninety degree hybrid coupler and the second ninety degree hybrid coupler.

15. The dual mode array antenna of claim 14, wherein the first ninety degree coupler further comprises a first isolation port; wherein the second ninety degree hybrid coupler further comprises a second isolation port; and wherein reflected power is terminated via resistive match termination at the first isolation port and the second isolation port.

16. A method of operating a dual mode array antenna comprising:

tuning the array antenna to a resonant frequency;

radiating energy from a plurality of antenna elements between an upper frequency and a lower frequency; wherein each of the plurality of antenna elements includes at least one spiral arm; wherein each of the plurality of antenna elements is embedded in a cavity defined by a base; and wherein a depth of the cavity is less than half of a wavelength at the upper frequency of the array antenna.

17. The method of operating the dual mode array antenna of claim 16, wherein the resonant frequency is a first resonant frequency; the method further comprising:

radiating energy from a plurality of antenna elements in at least one of the first resonant frequency and a second resonant frequency.

18. The method of operating the dual mode array antenna of claim 16, wherein the wavelength is a first wavelength; and wherein the depth of the cavity is approximately equal to or less than one tenth of a second wavelength above the ground plane at the lower frequency.

19. The method of operating the dual mode array antenna of claim 16, wherein the at least one spiral arm includes a plurality of spiral arms; and wherein the method further comprises:

engaging a vertical plate to each of the at least one spiral arm; wherein tuning the array to the resonant frequency is accomplished at least in part, through capacitive tuning via the vertical plate; and exciting the plurality of spiral arms with signals such that the signals maintain a relative phase of ninety degrees between each of the plurality of spiral arms.

20. The method of operating the dual mode array antenna of claim 16, wherein the at least one spiral arm includes four spiral arms; and wherein the method further comprises:

engaging a first ninety degree hybrid coupler with two of the four spiral arms; wherein the first ninety degree hybrid coupler includes a first isolation port;

engaging a second ninety degree hybrid coupler with the other two of the four spiral arms; wherein the first ninety degree hybrid coupler includes a second isolation port;

engaging a one hundred eighty degree hybrid coupler with the first ninety degree hybrid coupler and the second ninety degree hybrid coupler; and terminating reflected power via resistive match termination at the first isolation port and the second isolation port.

* * * * *